United States Patent [19]

Wagner et al.

[11] Patent Number: 4,582,028

[45] Date of Patent: Apr. 15, 1986

[54] INTERNAL COMBUSTION, RECIPROCATING PISTON, LIQUID COOLING ENGINE

[75] Inventors: Johann Wagner; Gerhard Feichtinger; Othmar Skatsche; Robert Hofer, all of Graz, Austria

[73] Assignee: AVL Gesellschaft für Verbrennungskraftmaschinen und Messtechnik mbH, Graz, Austria

[21] Appl. No.: 677,477

[22] Filed: Dec. 3, 1984

[30] Foreign Application Priority Data

Dec. 13, 1983 [AT] Austria ..... 4337/83

[51] Int. Cl.[4] ..... F01P 3/02

[52] U.S. Cl. ..... 123/41.82 R; 123/41.84; 123/193 CH

[58] Field of Search ..... 123/41.72, 41.74, 41.82 R, 123/41.82 A, 41.84, 193 C, 193 CH

[56] References Cited

U.S. PATENT DOCUMENTS

| | | | |
|---|---|---|---|
| 1,529,059 | 3/1925 | Frey | 123/193 CH |
| 3,173,407 | 3/1965 | Sampietro et al. | 123/41.74 |
| 3,744,462 | 7/1973 | Herschmann et al. | 123/41.82 |
| 4,108,135 | 8/1978 | Kubis | 123/41.84 |

*Primary Examiner*—William A. Cuchlinski, Jr.
*Attorney, Agent, or Firm*—Watson, Cole, Grindle & Watson

[57] ABSTRACT

Dry cylinder-liners are partly inserted into the liquid cooled lower part of a common cylinder head, which is fastened to an upwardly extended crankcase by means of crankshaft main bearing studs having their threads at the level of the inserted parts of the liners. Thus, cylinders and crankcase are stress-relieved, permitting a simple design and the use of less expensive materials and production methods.

4 Claims, 7 Drawing Figures

INTERNAL COMBUSTION, RECIPROCATING PISTON, LIQUID COOLING ENGINE

BACKGROUND OF THE INVENTION

The present invention relates to an internal combustion engine with reciprocating pistons and liquid cooling, with cylinders in line and one common cylinder head for all cylinders, whose liquid-cooled lower part supported on the upwardly extended crankcase contains dry cylinder liners, the cylinder liners being inserted into the lower part of the cylinder head, e.g, by pressing, and the cylinder head being fastened to the crankcase by means of studs.

DESCRIPTION OF THE PRIOR ART

In combustion engines of this known type the force generated by the combustion pressure and acting upon the cylinder head is transmitted to the main bearings of the crankshaft via cylinder and crankcase. This will induce a high degree of stress in the parts mentioned, which will complicate design and production and seriously increase costs.

SUMMARY OF THE INVENTION

It is an object of the present invention to eliminate the above disadvantages. The basic idea of the invention is to transmit the forces which are generated by the combustion pressure from the cylinder head to the main crankshaft bearings in the crankcase by means of through-bolts. The invention specifies that in a reciprocating engine of the above type the bolts used for fastening the cylinder head to the crankcase be main bearngs studs screwed into the cylinder head, the threads of these studs being arranged in the lower part of the cylinder head at the level of the inserted parts of the cylinder liners. In this way the cylinder and crankcase are relieved of the stress originating at the cylinder head, permitting a simple design and the use of less expensive materials and production methods. It will be possible, for instance, to make cylinder head and crankcase from pressure die-cast light metal. A special feature of the invention is that the layout of the water-passages in the cylinder head is not impeded.

In an embodiment of the invention the lower part of the cylinder head is partly designed as a water jacket, thus ensuring that a sufficient quantity of heat is carried off the area where the cylinder liners are inserted into the cylinder head in a way permitting good heat transfer.

In a further embodiment of the invention the cylinder head may carry a water chamber on the outside of each of its side walls, which water chambers are connected by bores situated above the bottom of the cylinder head and between the inlet and outlet valves of each cylinder, and between adjacent inlet and outlet valves of different cylinders. Thus the bottom of the cylinder head which is subject to high thermal loads, is efficiently cooled in a simple manner.

Another embodiment provides that the area of the lower part of the cylinder head located between the parts of the cylinder liners inserted into the latter, be provided with bores between the two water chambers, each bore preferably consisting of two "partial" bores running at an angle towards each other, which are drilled starting from the seating surface of the cylinder head and traverse the water chambers opening towards this surface. In this way the areas of the cylinder head located between the inserted parts of the cylinder liners and operating under particularly high thermal loads, are copiously supplied with the cooling medium.

DESCRIPTION OF THE DRAWINGS

The invention will now be further illustrated, by way of example only, with reference to the accompanying drawings in which FIG. 1 gives a longitudinal axial section according to line I—I in FIG. 2.

DESCRIPTION OF A PREFERRED EMBODINENT

Figure 1:
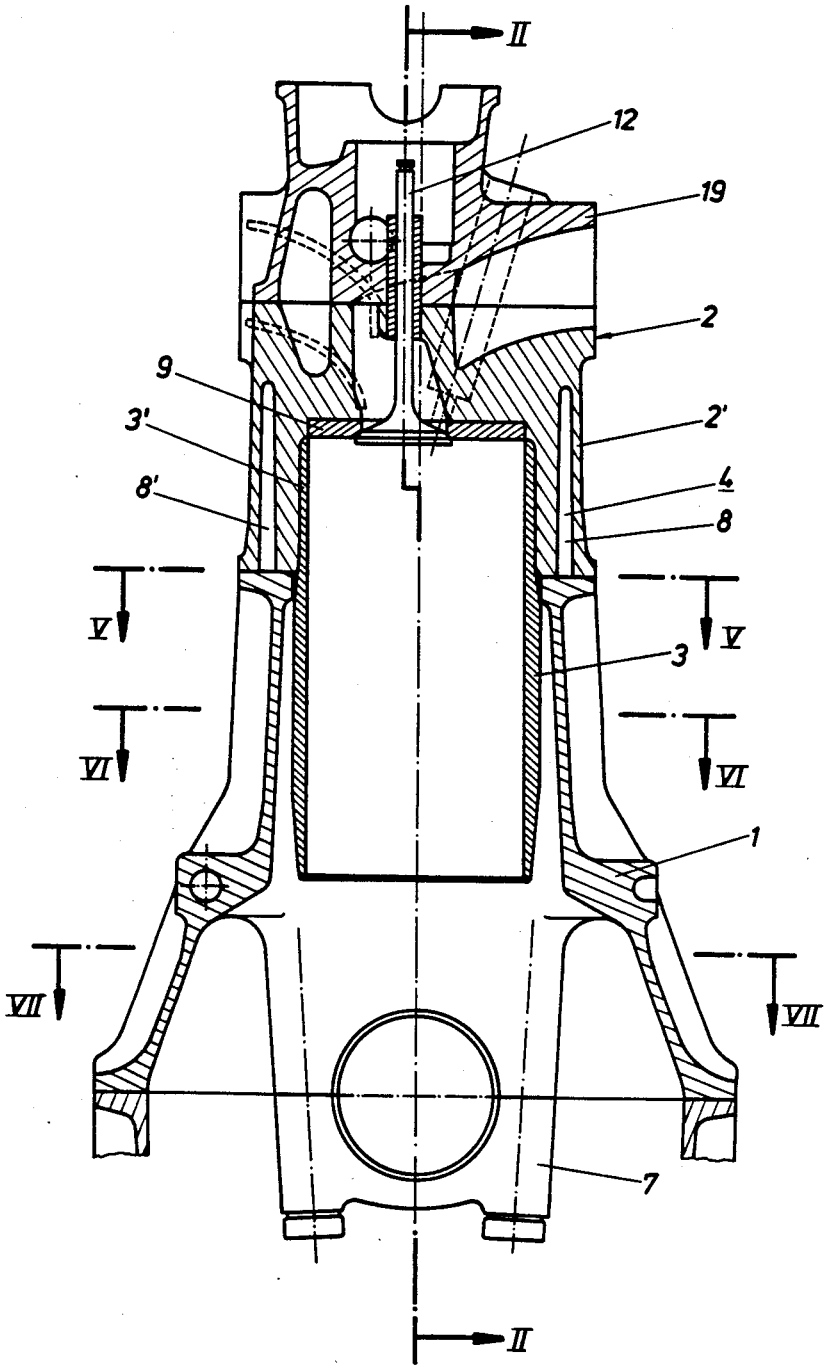
Figure 2:
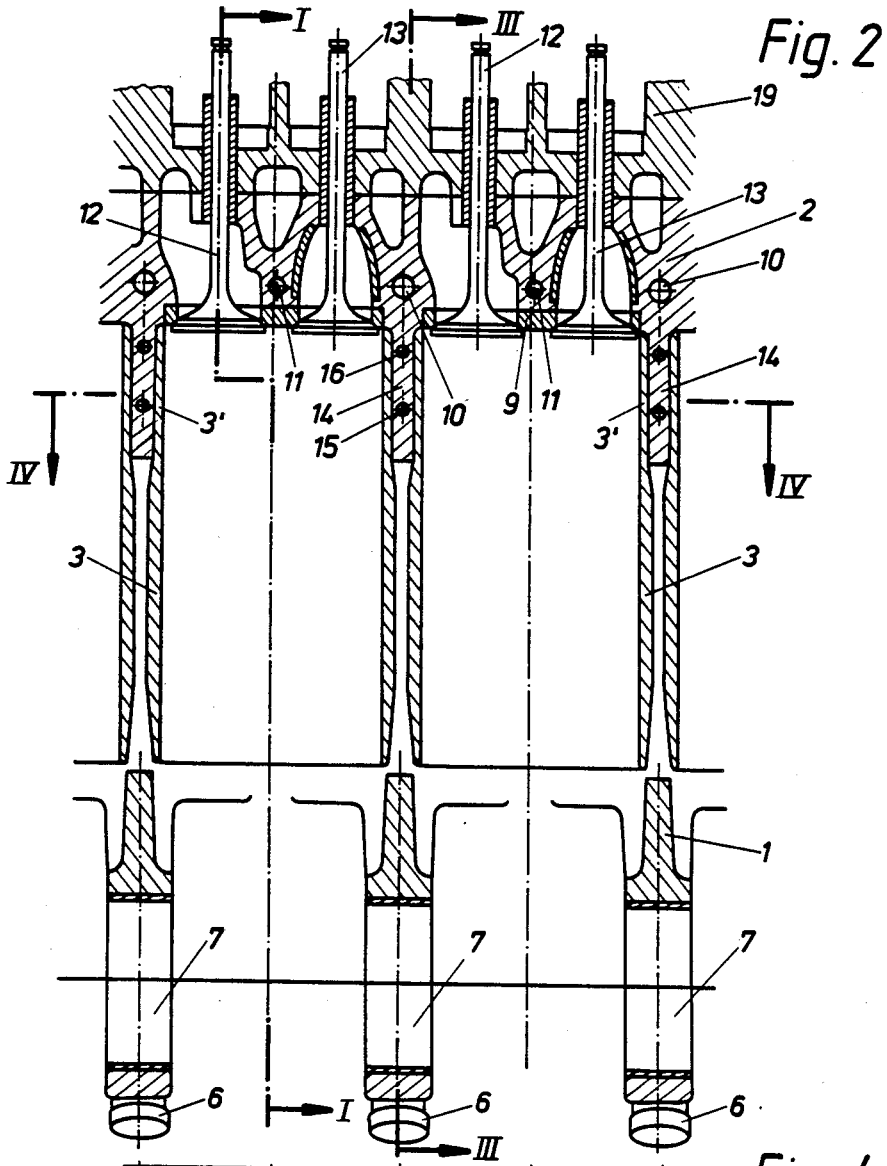
FIG. 2 a section according to line II—II in FIG. 1.
Figure 4:
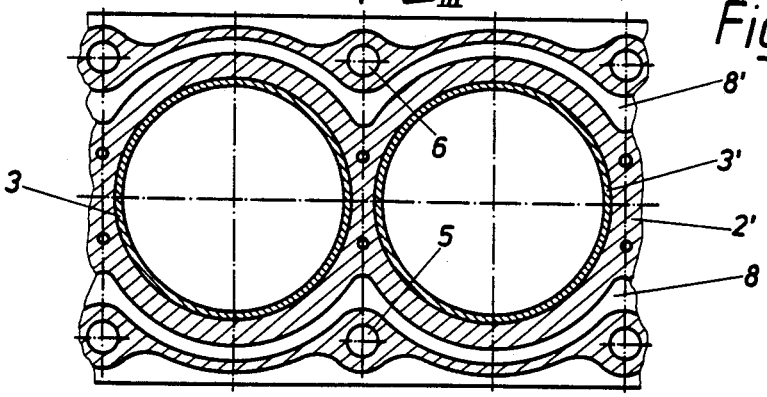
FIG. 4 a cross-section according to line IV—IV in FIG. 2.
Figure 3:
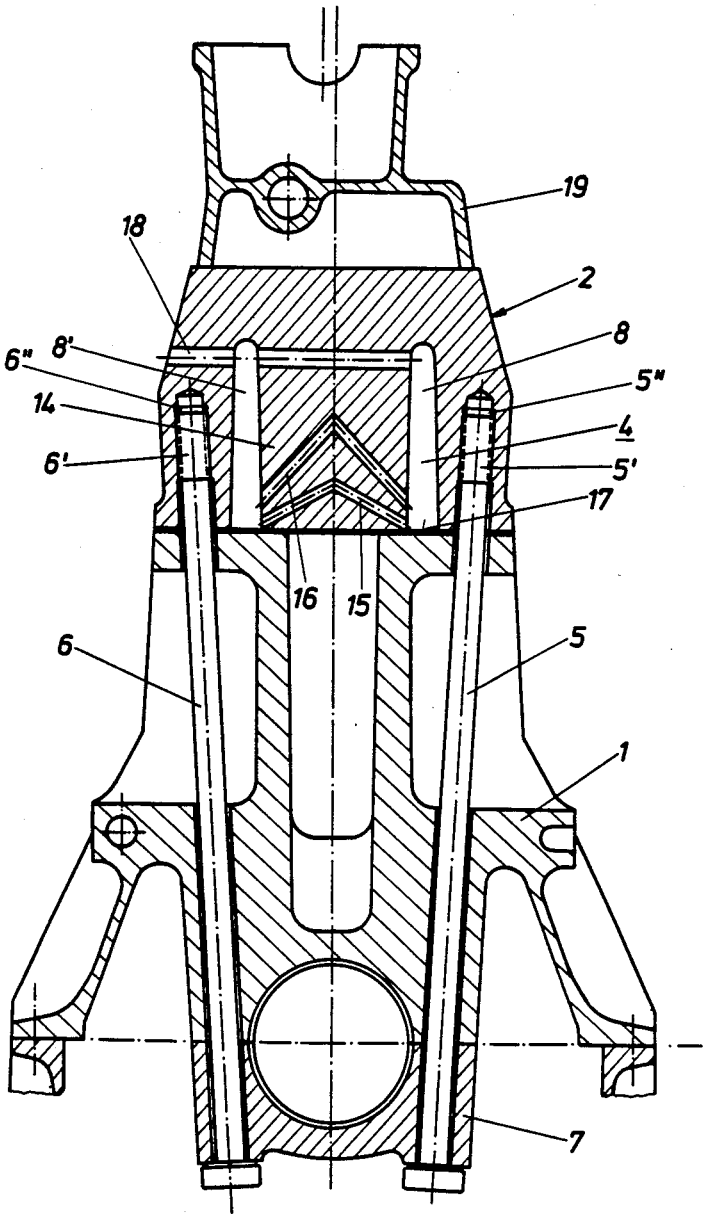
FIG. 3 a longitudinal section according to line III—III in FIG. 2.
Figure 5:
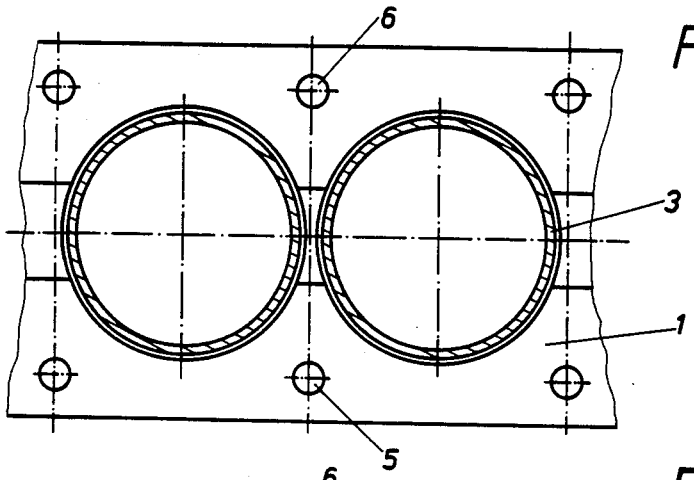
FIG. 5 a cross-section according to line V—V in FIG. 1.
Figure 6:
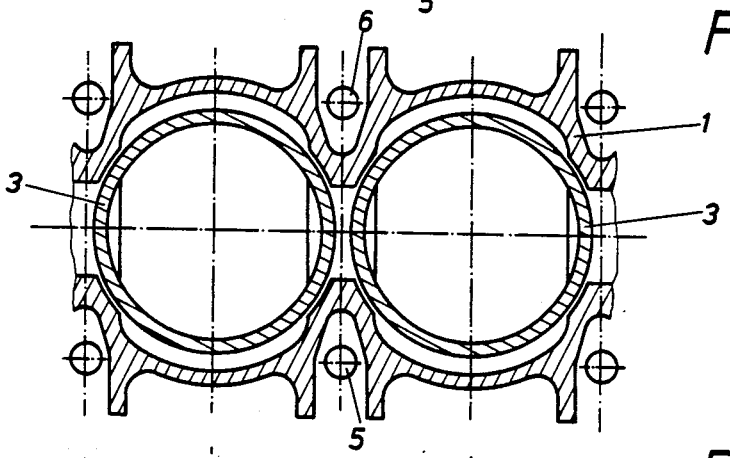
FIG. 6 a cross-section according to line VI—VI in FIG. 1.
Figure 7:
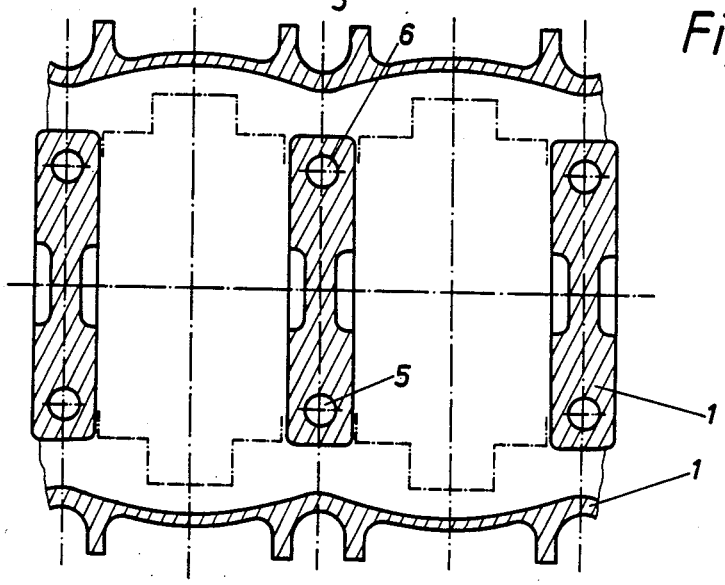
FIG. 7 a cross-section according to line VII—VII in FIG. 1.

A liquid-cooled in-line internal combustion engine has a crankcase 1 and a cylinder head 2 for all cylinders, of which only two are represented by cylinder liners 3. The cylinder liners 3 are inserted into a lower part 2' of the cylinder head 2, e.g, by pressing. In order to provide adequate cooling of the cylinder liners the cylinder head 2 comprises a water jacket 4. The cylinder head 2 is fastened to the crankcase 1 with main bearing studs 5 and 6, which pass through the crankcase 1 and are screwed into the cylinder head 2. For this purpose the main bearing studs have threaded ends 5' and 6' engaging corresponding threads 5'' and 6'' in the lower part 2' of the cylinder head 2. For greater strength bearing brackets 7 are made of steel, whereas, e.g, pressure die-cast light metal is used for the crankcase 1 and the cylinder head 2. A camshaft housing 19 mounted on the cylinder head 2 is not described in detail as it is not essential to this invention.

The water jacket 4 of the cylinder head 2 comprises water chambers 8 and 8' along outer side walls of the cylinder head 2, which are interconnected by bores 10, 11 situated above a bottom 9 of the cylinder head. Bores 10 are provided between every two cylinders and bores 11 between an inlet valve 12 and an outlet valve 13 of each cylinder. In addition, areas 14 of the lower part 2' of the cylinder head 2, which are located between parts 3' of the cylinder liners 3 inserted there, are provided with bores 15 and 16, establishing yet another connection between the two water chambers 8 and 8'. Each of these two bores 15, 16 comprise two partial bores which are drilled starting from a seating surface 17 of the cylinder head 2, traversing the water chambers 8, 8' opening towards that surface. The two water chambers 8, 8' are connected to a coolant circuit by feed lines not presented in this drawing; an outlet line thereof is indicated by reference number 18.

We claim:

1. In an internal combustion engine which, when vertically oriented, includes an elongated crankcase that includes lateral upwardly-extending portions and a plurality of vertically-movable pistons therebetween; a single elongated cylinder head which is positioned above said crankcase and which includes a lower portion that provides lateral bottom surfaces that are respectively mounted on the lateral upwardly-extending portions of said crankcase, the lower portion of said cylinder head including cylinder bores which extend upwardly therein to a certain level; dry cylinder liners which extend upwardly from said crankcase and respectively into said cylinder bores in the lower portion of said cylinder head and in which said pistons are respectively movable; and a plurality of main bearing studs which fixedly connect said crankcase to said cylinder head, said main bearing studs each having one threaded end; the improvement wherein the lower portion of said cylinder head includes blind threaded bores which extend upwardly therein to about said certain level, wherein said crankcase includes bearing bores extending upwardly therethrough which are aligned with said blind threaded bores, and wherein said main bearing studs extend upwardly through respective bearing bores and into said blind threaded bores such that the threaded ends of said main bearing studs are engaged with the threads in said blind threaded bores.

2. The internal combustion engine as defined in claim 1, wherein the lower portion of said cylinder head includes a water jacket channel for the flow of coolant liquid therethrough.

3. The internal combustion engine as defined in claim 2, wherein said cylinder head includes inlet and outlet valves extending therethrough to each of the cylinder bores in the lower portion thereof, said inlet and outlet valves being aligned in the longitudinal dimension of said elongated cylinder head, wherein the lower portion of said cylinder head includes two longitudinally extending water jacket channels along opposite lateral sides of said cylinder bores therein, and wherein the lower portion of said cylinder head includes first and second transversely-extending coolant passages connected between said two longitudinally-extending water jacket channels, said first transversely-extending coolant passageways respectively extending between the inlet and outlet valves associated with each cylinder bore and said second transversely-extending coolant passageways respectively extending between valves of adjacent cylinder bores.

4. The internal combustion engine as defined in claim 3, wherein the lower portion of said cylinder head includes third transversely-extending coolant passageways connected between said two-longitudinally-extending water jacket channels, each third transversely-extending coolant passageway being located between said cylinder bores and having a first upwardly-extending portion and a second downwardly-extending portion.

* * * * *

UNITED STATES PATENT AND TRADEMARK OFFICE

CERTIFICATE OF CORRECTION

PATENT NO. : 4,582,028

DATED : April 15, 1986

INVENTOR(S) : Johann Wagner et al.

It is certified that error appears in the above-identified patent and that said Letters Patent is hereby corrected as shown below:

On the title page assignee should read:

-- [73] Assignee: AVL Gesellschaft für Verbrennungskraftmaschinen und Messtechnik mbH. Prof.Dr.Dr.h.c. Hans List --

Signed and Sealed this

*Twenty-second* Day of *July 1986*

[SEAL]

*Attest:*

DONALD J. QUIGG

*Attesting Officer*

*Commissioner of Patents and Trademarks*